US009329541B2

(12) United States Patent
Matsuo

(10) Patent No.: US 9,329,541 B2
(45) Date of Patent: May 3, 2016

(54) IMAGE FORMING APPARATUS

(71) Applicant: Konica Minolta, Inc., Tokyo (JP)

(72) Inventor: Masahiro Matsuo, Kokubunji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/862,849

(22) Filed: Sep. 23, 2015

(65) Prior Publication Data

US 2016/0091844 A1 Mar. 31, 2016

(30) Foreign Application Priority Data

Sep. 29, 2014 (JP) ..... 2014-197729

(51) Int. Cl.
*G03G 15/20* (2006.01)
*G03G 15/00* (2006.01)

(52) U.S. Cl.
CPC ..... *G03G 15/2039* (2013.01); *G03G 15/2028* (2013.01); *G03G 15/6517* (2013.01); *G03G 15/6558* (2013.01); *G03G 2215/00371* (2013.01); *G03G 2215/00556* (2013.01); *G03G 2215/00603* (2013.01)

(58) Field of Classification Search
CPC ..... G03G 15/2028; G03G 15/2035; G03G 15/6517; G03G 15/6558; G03G 2215/00371; G03G 2215/00556; G03G 2215/00603
See application file for complete search history.

(56) References Cited

U.S. PATENT DOCUMENTS

2007/0047989 A1* 3/2007 Nakamura ..... G03G 15/2039 399/67
2008/0212991 A1* 9/2008 Nakamura ..... G03G 15/2039 399/70
2011/0229236 A1* 9/2011 Ehara ..... G03G 15/205 399/400
2015/0241821 A1* 8/2015 Fukai ..... G03G 15/6564 399/70
2015/0316879 A1* 11/2015 Koyama ..... G03G 15/2017 399/69

FOREIGN PATENT DOCUMENTS

JP 2010079086 A 4/2010

* cited by examiner

*Primary Examiner* — Ryan Walsh
(74) *Attorney, Agent, or Firm* — Lucas & Mercanti, LLP

(57) ABSTRACT

An image forming apparatus includes a sheet conveyance unit which conveys a long sheet having such a length as to extend at least from a sheet feed opening to a sheet output opening of an apparatus body, an image forming unit which transfers a toner image onto the sheet, a fixing unit including a heater to fix the transferred toner image, a temperature detector which detects a temperature of the fixing unit, and a control unit which controls the sheet conveyance unit in such a way that, when the front edge of the sheet is to be conveyed from the sheet feed opening to the sheet output opening with no toner image transferred onto the sheet, the front edge is prohibited from being conveyed into the fixing unit if the temperature of the fixing unit is higher than a first predetermined temperature.

9 Claims, 15 Drawing Sheets

FIG. 6

FIXING UNIT IS AT HIGH TEMPERATURE.
DO NOT FEED SHEET.

IMAGE FORMING APPARATUS

BACKGROUND OF THE INVENTION

1. Field of the Invention

The present invention relates to an electrophotographic image forming apparatus to form images on long sheets.

2. Description of Related Art

In a typical image forming apparatus using electrophotography, uniformly-charged photoreceptors are irradiated with (exposed to) laser light based on image data and thus electrostatic latent images are formed on the surfaces of the photoreceptors. Toners are then supplied onto the photoreceptors on which the electrostatic latent images have been formed. This process visualizes the electrostatic latent images to form toner images. The toner images are transferred onto a sheet directly or indirectly through an intermediate transfer member, and then the transferred toner images are heated and pressurized at a fixing unit. An image is thus formed on the sheet.

Unfortunately, such an image forming apparatus gives damages to sheets (e.g., deformation and discoloration of sheets and image defects on sheets) due to the heat from the fixing unit.

Japanese Unexamined Patent Application Publication No. 2010-79086 discloses an image forming apparatus that adjusts the temperature of a pressure member constituting a fixing unit to a predetermined scope to reduce image defects on sheets.

In a case in which a sheet used for image formation is a long sheet, such as roll paper, to extend from the sheet feed opening to the sheet output opening of an image forming apparatus body, the long sheet needs to be disposed through the image forming apparatus body to extend from the sheet feed opening to the sheet output opening before the image formation, so that the long sheet can be wound adjacent to the sheet output opening (printing preparation). If the long sheet is conveyed into the fixing unit while the fixing unit is at a temperature at which the fixing unit can actually perform fixation, the front edge of the long sheet may be wound around the fixing unit or discoloration and deformation of the long sheet may be caused because the fixing unit continues to transfer heat to the long sheet staying in the fixing unit during the time from completion of the printing preparation to the start of the image formation.

SUMMARY OF THE INVENTION

An object of the present invention is to provide an image forming apparatus which performs image formation on a long sheet and which can prevent the long sheet from being wound around a fixing unit at the time of the printing preparation and can prevent deformation and discoloration of the long sheet before the start of the image formation.

In order to achieve the object, an image forming apparatus according to an aspect of the present invention includes a sheet conveyance unit which conveys a long sheet having such a length that the long sheet is to extend at least from a sheet feed opening to a sheet output opening of an image forming apparatus body, an image forming unit which transfers a toner image onto the long sheet, a fixing unit including a heater to fix the transferred toner image, a temperature detector which detects a temperature of the fixing unit, and a control unit which controls the sheet conveyance unit to convey the long sheet through the sheet feed opening of the image forming apparatus body, the image forming unit, the fixing unit, and the sheet output opening of the image forming apparatus body in this order, wherein the control unit controls the sheet conveyance unit in such a way that, when the sheet conveyance unit is to convey a front edge of the long sheet from the sheet feed opening to the sheet output opening of the image forming apparatus body with no toner image transferred onto the long sheet by the image forming unit, the front edge of the long sheet is prohibited from being conveyed into the fixing unit if the temperature of the fixing unit detected by the temperature detector is higher than a first predetermined temperature.

Preferably, in the image forming apparatus, the control unit checks for job reservation information on a job reservation, and sets or changes the first predetermined temperature on the basis of the job reservation information.

Preferably, in the image forming apparatus, the job reservation information includes information on existence or non-existence of the job reservation.

Preferably, in the image forming apparatus, the control unit sets or changes the first predetermined temperature on the basis of at least one of a type, a thickness, and a width of the long sheet.

Preferably, in the image forming apparatus, the sheet conveyance unit includes an automatic conveyance unit which performs an automatic conveyance to automatically convey the front edge of the long sheet at least from the sheet feed opening to the sheet output opening of the image forming apparatus body, and the control unit stops receiving a conveyance instruction if the temperature of the fixing unit is higher than the first predetermined temperature, the conveyance instruction being an instruction to allow the automatic conveyance unit to start the automatic conveyance.

Preferably, in the image forming apparatus, the sheet conveyance unit includes a sheet detector which detects existence of the long sheet upstream of the fixing unit on a sheet conveyance pathway, and if the temperature of the fixing unit is higher than the first predetermined temperature and the sheet detector detects the long sheet, the control unit prohibits the front edge of the long sheet from being conveyed.

Preferably, in the image forming apparatus, the sheet conveyance unit includes a sheet conveyance blocking member which blocks conveyance of the long sheet, the sheet conveyance blocking member being disposed upstream of the fixing unit on a sheet conveyance pathway, and the control unit allows the sheet conveyance blocking member to block the conveyance of the long sheet if the temperature of the fixing unit is higher than the first predetermined temperature.

Preferably, the image forming apparatus further includes a display unit on which the control unit displays information based on a signal input from the control unit, wherein the control unit displays, on the display unit, a warning which tells a user not to convey the front edge of the long sheet to prohibit the front edge of the long sheet from being conveyed if the temperature of the fixing unit is higher than the first predetermined temperature.

Preferably, in the image forming apparatus, the control unit resumes or starts conveying the front edge of the long sheet if the temperature of the fixing unit becomes equal to or less than a second predetermined temperature after the control unit prohibits the front edge of the long sheet from being conveyed into the fixing unit.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 6 shows a warning message according to the first to sixth embodiments of the present invention;

DESCRIPTION OF THE PREFERRED EMBODIMENTS

Embodiments

Embodiments of the present invention will now be described in detail with reference to the drawings.

The configuration of an image forming apparatus 1 common to all the embodiments is described first, and then each embodiment is to be described using the relevant flowchart.

Figure 1:
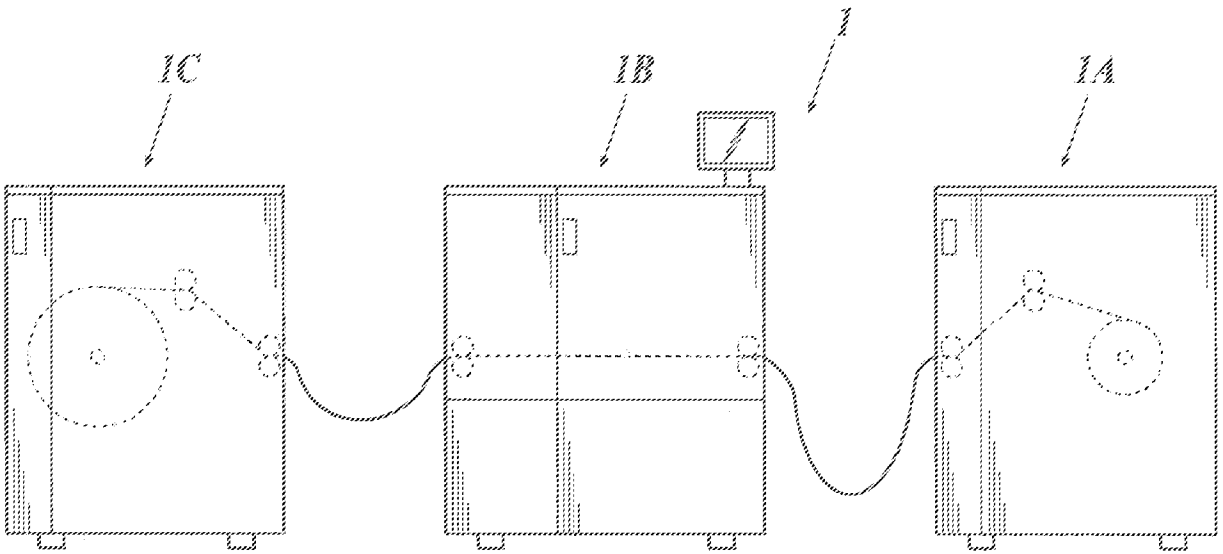
FIG. 1 shows an image forming apparatus according embodiments of the present invention.

FIG. 1 shows the image forming apparatus 1 according to embodiments of the present invention.

As shown in FIG. 1, the image forming apparatus 1 includes a sheet feeder 1A, an image forming apparatus body 1B, and a winder 1C.

The sheet feeder 1A contains a long sheet, such as roll paper and continuous form paper, and feeds the long sheet in accordance with the instructions from the image forming apparatus body 1B. The image forming apparatus body 1B forms an image on the long sheet fed from the sheet feeder 1A. The winder 1C winds the long sheet on which the image has been formed in the image forming apparatus body 1B and which has been output from the image forming apparatus body 1B.

Figure 2:
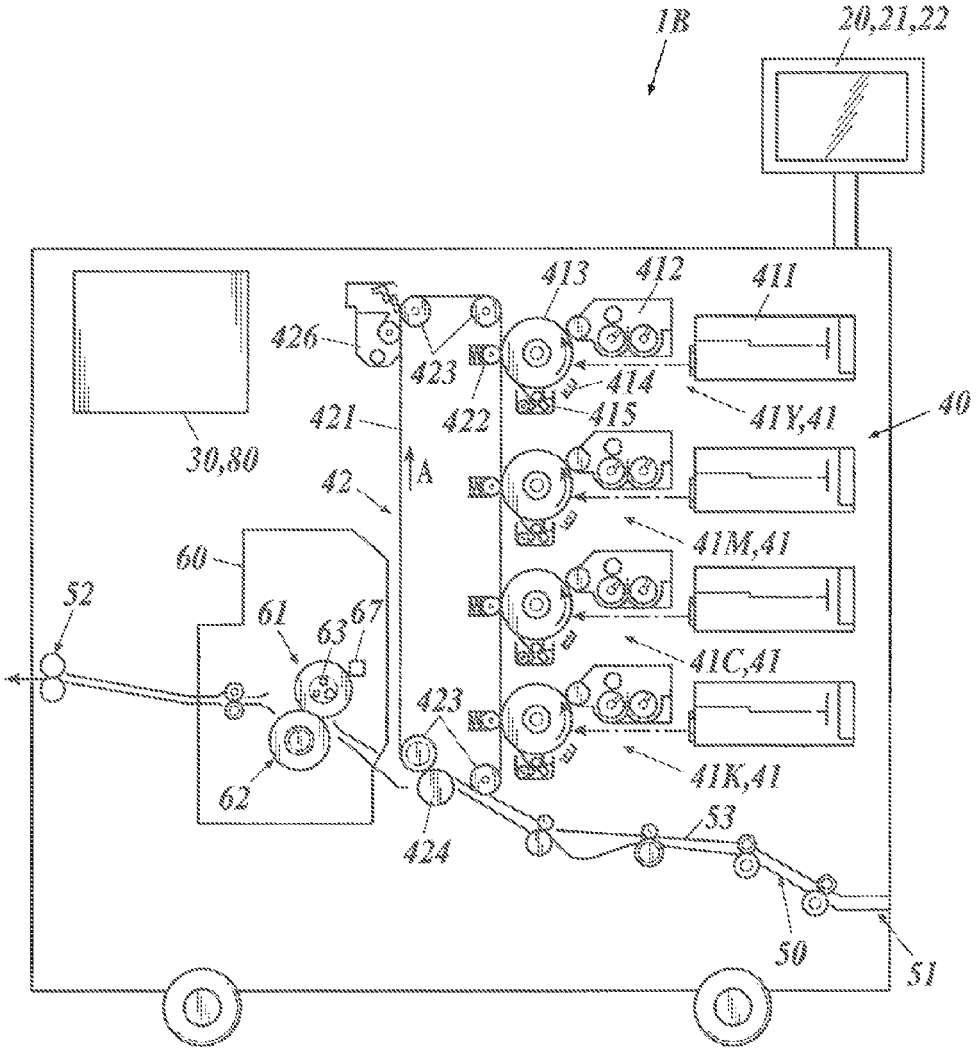
FIG. 2 shows the overall configuration of an image forming apparatus body.
Figure 3:
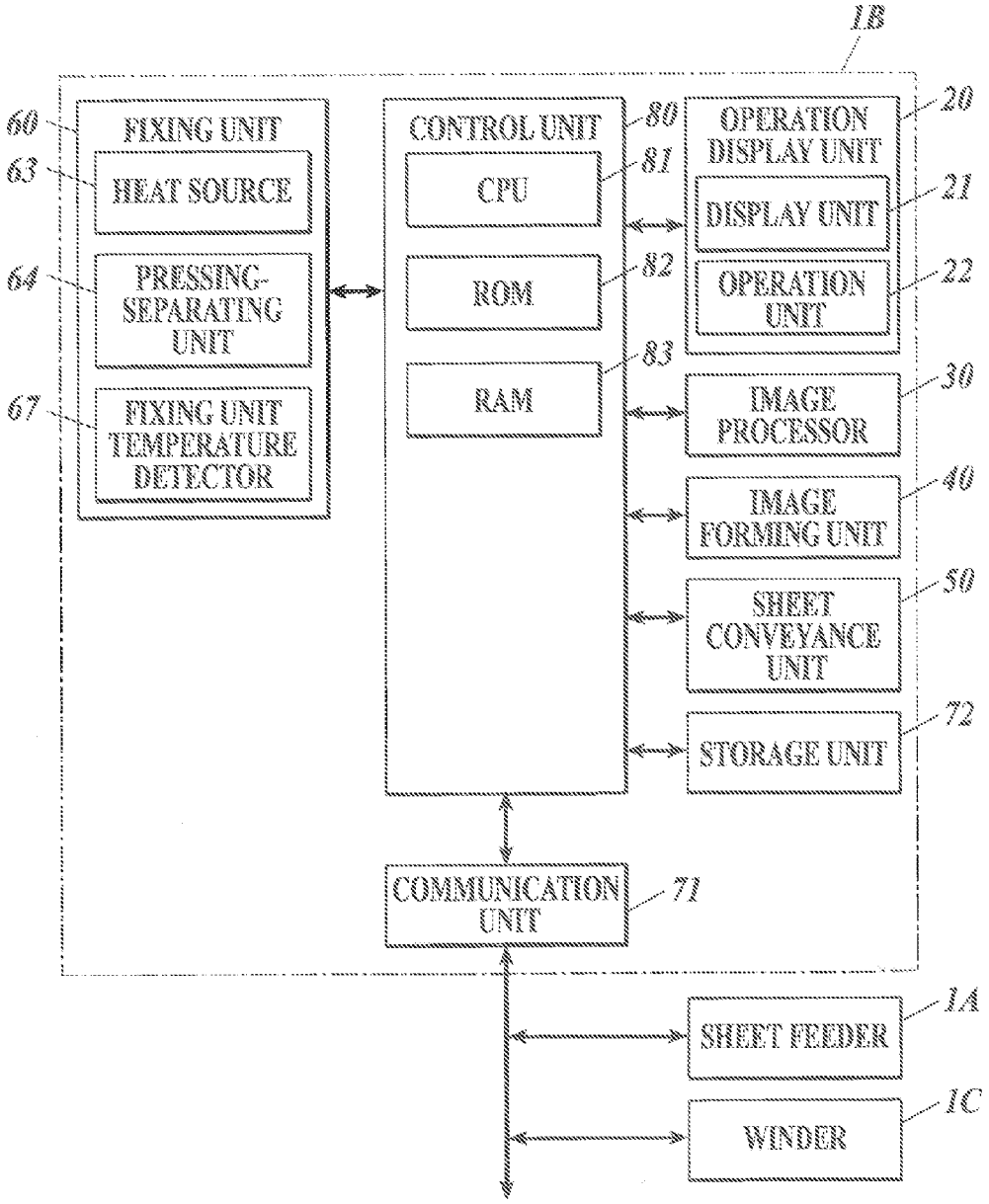
FIG. 3 shows principal parts of the control system of the image forming apparatus body.

FIG. 2 shows the overall configuration of the image forming apparatus body 1B. FIG. 3 shows principal parts of the control system of the image forming apparatus body 1B.

The image forming apparatus body 1B as sown in FIGS. 2 and 3 is a color image forming apparatus having an intermediate transfer system using electrophotography. The image forming apparatus body 1B contains photoreceptor drums 413 for four colors, yellow (Y), magenta (M), cyan (C), and black (K) which are arranged tandem. Specifically, the four photoreceptor drums 413 are arranged in series in the direction in which an intermediate transfer belt 421 runs (i.e., the vertical direction) so that the four color toner images on the four photoreceptor drums 413 are sequentially transferred onto the intermediate transfer belt 421. More specifically, YMCK toner images formed on the respective photoreceptor drums 413 are primarily transferred onto the intermediate transfer belt 421 to be laid on top of one another on the intermediate transfer belt 421, and then the overlaid images are secondarily transferred onto a sheet. The image forming apparatus body 1B thus forms an image on the sheet.

As shown in FIGS. 2 and 3, the image forming apparatus body 1B includes an operation display unit 20, an image processor 30, an image forming unit 40, a sheet conveyance unit 50, a fixing unit 60, and a control unit 80.

The control unit 80 includes a CPU 81, a ROM 82, and a RAM 83 etc. The CPU 81 reads out a program according to processing details from the ROM 82 or a storage unit 72, loads the program into the RAM 83, and controls the operations of the blocks in the image forming apparatus body 1B, the sheet feeder 1A, and the winder 1C in cooperation with the loaded program.

The communication unit 71 includes various interfaces, such as a network card, a modem, and a USB. The storage unit 72 is constituted of, for example, a non-volatile semiconductor memory (i.e., a so-called flash memory) or a hard disk drive. The storage unit 72 stores look-up tables to be referred to when the operations of the blocks are controlled, for example.

The control unit 80 transmits and receives various data items, via the communication unit 71, to and from an external device(s) (e.g., a personal computer) connected to a communication network, such as a local area network (LAN) and a wide area network (WAN). The control unit 80, for example, receives image data (or input image data) in a page-description language (PDL) transmitted from an external device, and forms an image on a sheet based on the received image data. The control unit 80 also transmits and receives various data items, via the communication unit 71, to and from the sheet feeder 1A and the winder 1C.

The operation display unit 20 is constituted of, for example, a liquid crystal display (LCD) with a touch panel and serves as the display unit 21 and the operation unit 22.

The display unit 21 displays various operation screens and operation statuses of the functions etc. in response to display control signals input from the control unit 80. The display unit 21 also receives touch operations from a user and outputs operation signals to the control unit 80.

The operation unit 22 includes various operation keys, such as a numeric keypad and a start key. The operation unit 22 receives various input operations from a user and outputs operation signals to the control unit 80. A user operates the operation display unit 20 to make settings related to image formation, such as image quality settings, magnification settings, applied settings, output settings, and sheet settings; and to input an instruction for a conveyance of a sheet.

The image processor 30 includes circuits to perform digital image processing on the input image data according to default settings or user settings. For example, the image processor 30 corrects gradation with reference to gradation correction data (or a gradation correction table) under the control of the control unit 80. The image processor 30 also performs various correction processes, such as a color correction and a shading correction, and a compression process on the input image data. The image forming unit 40 is controlled on the basis of the image data on which these processes have been performed.

The image forming unit 40 includes image forming sub-units 41 and an intermediate transfer unit 42 etc. to form images with colored toners of a Y component, an M component, a C component, and a K component on the basis of the input image data.

The image forming sub-units 41 consist of four image forming sub-units 41Y, 41M, 41C, and 41K for Y, M, C, and K components, respectively. The image forming sub-units 41Y, 41M, 41C, and 41K have the same configuration, and so common constituent elements are indicated by the same referential numerals to simplify the drawings and the description. In FIG. 2, the constituent elements of only the image forming sub-unit 41Y for Y component are assigned with referential numerals, and the referential numerals of the constituent elements of the other image forming sub-units 41M, 41C, 41K are omitted.

Each of the image forming sub-units 41 includes an exposure device 411, a developing device 412, a photoreceptor drum 413, a charging device 414, and a drum cleaner 415 etc.

The photoreceptor drum 413, which is a negatively-charged organic photoreceptor (OPC), includes an aluminum conductive cylindrical body (aluminum pipe) and an undercoat layer (UCL), a charge generation layer (CGL), and a charge transport layer (CTL) disposed in this order on the surface of the aluminum conductive cylindrical body, for example. The charge generation layer is composed of an organic semiconductor obtained by dispersing charge generation material (e.g., phthalocyanine pigment) in a resin binder (e.g., polycarbonates). The charge generation layer generates a pair of positive charge and negative charge when exposed by the exposure device 411. The charge transport layer is obtained by dispersing hole transport material (electron donor-containing nitrogen compounds) in a resin binder (e.g., polycarbonate resins) and transports the positive charge generated in the charge generation layer to the surface of the charge transport layer.

The charging device 414 is constituted of a corona discharge generator, such as a scorotron charging device and a corotron charging device. The charging device 414 negatively and uniformly charges the surface of the photoreceptor drum 413 by a corona discharge.

The exposure device 411 is constituted of an LED print head including, for example, an LED array which is a linear array of multiple light-emitting diodes (LEDs), LPH drivers (or driver ICs) to drive the respective LEDs, and a lens array to form an image on the photoreceptor drum 413 with light emitted from the LED array. One LED of the LED array corresponds to one dot of the image. The control unit 80 controls the LPH drives in such a way that predetermined driving current flows in the LED array and that particular LEDs emit light.

The exposure device 411 irradiates the photoreceptor drum 413 with light for the image of the relevant color component. The positive charge generated in the charge generation layer of the photoreceptor drum 413 is transported to the surface of the charge transport layer, and thereby the surface charge (negative charge) of the photoreceptor drum 413 is neutralized. Such a process allows an electrostatic latent image of the relevant color component to be formed on the surface of the photoreceptor drum 413 due to a potential difference between the irradiated part and the other part of the surface of the photoreceptor drum 413.

The developing device 412 contains a developer of the relevant color component, which developer is a two-component developer composed of, for example, a toner and a magnetic carrier. The developing device 412 applies a toner of the relevant color component to the surface of the photoreceptor drum 413 to visualize to the electrostatic latent image and thereby forms a toner image. Specifically, when a bias voltage for development is applied to a developer support (or a developing roller), the potential difference between the photoreceptor drum 413 and the developer support causes the charged toner on the developer support to move to an exposed part of the surface of the photoreceptor drum 413 and to adhere to the exposed part.

The drum cleaner 415 has a drum cleaning blade etc. to be in slidably contact with the surface of the photoreceptor drum 413 to remove transfer residual toner remaining on the surface of the photoreceptor drum 413 after a primary transfer.

The intermediate transfer unit 42 includes the intermediate transfer belt 421, primary transfer rollers 422, support rollers 423, a secondary transfer roller 424, and a belt cleaner 426 etc.

The intermediate transfer belt 421, which is constituted of an endless loop belt, is stretched over the support rollers 423. At least one of the support rollers 423 is a driving roller and the others are driven rollers. For example, a support roller 423 that is disposed downstream of the primary transfer roller 422 for the K component in the direction in which the belt 421 runs is preferably a driving roller. Rotation of the driving roller causes the intermediate transfer belt 421 to run in the direction indicated by the arrow A in a constant speed.

Each of the primary transfer rollers 422 is disposed on the inner periphery of the intermediate transfer belt 421 so as to face the photoreceptor drum 413 of the relevant color component. The primary transfer rollers 422 are pressed against the respective photoreceptor drums 413 through the intermediate transfer belt 421 to form primary transfer nip parts at which toner images are transferred from the respective photoreceptor drums 413 to the intermediate transfer belt 421.

The secondary transfer roller 424 is disposed on the outer periphery of the intermediate transfer belt 421 so as to face one of the support rollers 423. The support roller 423 facing the secondary transfer roller 424 is called a backup roller. The secondary transfer roller 424 is pressed against the backup roller with the intermediate transfer belt 421 therebetween to form a secondary transfer nip part at which the toner images are transferred from the intermediate transfer belt 421 to a sheet.

When the intermediate transfer belt 421 passes through the primary transfer nip parts, the toner images on the respective photoreceptor drums 413 are primarily transferred onto the intermediate transfer belt 421 in sequence to be overlaid on top of one another. Specifically, a bias voltage for primary transfer is applied to the primary transfer rollers 422 so that a charge having a polarity opposite to the polarity of to the toners is given to the back side of the intermediate transfer belt 421 (i.e., the side where the intermediate transfer belt 421 is in contact with the primary transfer rollers 422). The toner images are thus electrostatically transferred onto the intermediate transfer belt 421.

The toner images on the intermediate transfer belt 421 are then secondarily transferred onto a sheet when the sheet passes through the secondary transfer nip part. Specifically, a bias voltage for secondary transfer is applied to the secondary transfer roller 424 so that a charge having a polarity opposite to the polarity of to the toners is given to the back side of the sheet (i.e., the side where the sheet is in contact with the secondary transfer roller 424). The toner images are thus electrostatically transferred onto the sheet. The sheet on which the toner images have been transferred is conveyed to the fixing unit 60.

The belt cleaner 426 has a belt cleaning blade etc. to be in slidably contact with the surface of the intermediate transfer belt 421 to remove transfer residual toner remaining on the surface of the intermediate transfer belt 421 after the secondary transfer.

The intermediate transfer unit 42 may have, instead of the secondary transfer roller 424, a loop secondary transfer belt stretched over multiple support rollers including a secondary transfer roller (i.e., a so-called belt secondary transfer unit).

The fixing unit 60 includes an upper fixing unit 61 having a fixation-side member disposed to be adjacent to the fixation face (i.e., the face on which toner images are formed) of a sheet, a lower fixing unit 62 having a back-side support member disposed to be adjacent to the back face (i.e., the face opposite from the fixation face) of a sheet, a heat source 63 to heat the fixation-side member, a pressing-separating unit 64 to press the back-side support member against the fixation-side member, and a fixing unit temperature detector 67 to detect the fixing unit temperature etc.

Examples of the fixation-side member include a fixing roller and a fixing belt. Examples of the back-side support member include a pressure roller and a pressure belt.

The heat source 63 is disposed inside of or near the fixation-side member. The control unit 80 controls the output of the heat source 63 so that the heat source 63 heats the fixation-side member to make the fixing unit temperature a temperature necessary for fixation of toner images. The control unit 80 controls the output of the heat source 63 on the basis of the detection results obtained by the fixing unit temperature detector 67 disposed near the fixation-side member.

The control unit 80 controls the operation of the pressing-separating unit 64 to press the back-side support member against the fixation-side member to form a fixation nip part at which a sheet is held between the fixation-side member and the back-side support member to be conveyed. The sheet on which toner images have been secondarily transferred and which has been conveyed along a sheet pathway is heated and pressurized when passing thorough the fixation nip part. The toner images are thus fixed onto the sheet.

The sheet conveyance unit 50 includes a sheet feeding section 51, a sheet output section 52, and a sheet pathway section 53 etc.

The sheet feeding section 51 guides a long sheet from the sheet feeder 1A to the sheet pathway section 53.

The sheet pathway section 53 includes multiple conveyance roller parts including an intermediate conveyance roller part, a loop roller part, and a registration roller part. The sheet pathway section 53 sends the long sheet, which has been fed from the sheet feeding section 51, to the image forming unit 40 (secondary transfer section), the fixing unit 60, and the sheet output section 52 in this order.

The sheet output section 52 guides the long sheet, which has been sent from the sheet pathway section 53, to the winder 1C.

Figure 4:
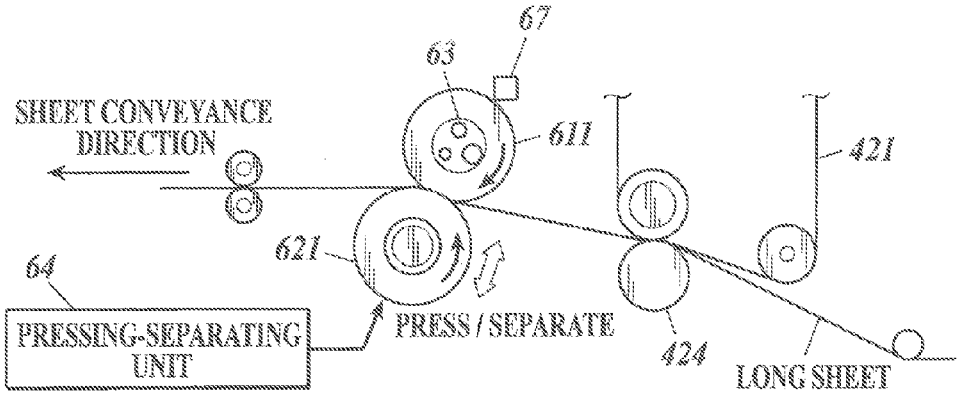
FIG. 4 shows an example configuration of a fixing unit.

FIG. 4 shows an example configuration of the fixing unit 60. FIG. 4 shows a case in which the fixation-side member includes a fixing roller 611 and in which the back-side support member includes a pressure roller 621.

Several embodiments of a process performed by the control unit 80 to prohibit the front edge of a long sheet from being conveyed into the fixing unit 60 will now be descried.

Before the image forming unit 40 performs image formation, a long sheet has to be disposed in such a way that the sheet extends from the sheet feeder 1A through the sheet pathway section 53 to the winder 1C as a preliminary step (i.e., a printing preparation). The printing preparation may be automatically performed by the sheet conveyance unit 50 or may be manually performed.

After the printing preparation, the long sheet extending from the sheet feeder 1A to the winder 1C is conveyed when the image forming unit 40 forms an image on the long sheet. When the long sheet passes through the secondary transfer nip part, the toner images on the intermediate transfer belt 421 are secondarily transferred onto a first face (i.e., the fixation face) of the long sheet collectively and then the fixing process is performed in the fixing unit 60. The long sheet on which the image formation has been performed is output from the apparatus body through the sheet output section 52 using sheet output rollers etc. and then is wound by the winder 1C.

When the image forming apparatus 1 performs the printing preparation or is in a standby state, the fixing unit temperature is preferably kept at such a temperature that does not cause change in color or shape of the long sheet so that the long sheet is in the condition that does not cause discoloration or deformation of the sheet.

At this time, the control unit 80 controls the output of the heat source 63 on the basis of the detection results obtained by the fixing unit temperature detector 67 so as to keep the temperature of the fixing roller 611 equal to or less than a threshold temperature that does not cause discoloration and deformation of the long sheet.

If the last image formation is canceled due to some malfunction, such as jam, or if remaining sheet is not long enough (i.e., out of sheet), there is a need to remove the long sheet remaining in the sheet pathway section 53 and to perform the printing preparation for placing a new long sheet in the image forming apparatus body 1B. If the printing preparation is to be performed immediately after the long sheet has been removed, the fixing unit temperature may be higher than the threshold temperature.

Performing the printing preparation in such conditions may cause discoloration or deformation of the long sheet. Further, if the apparatus is in a standby state after the printing preparation before the image formation, the long sheet may absorb the heat from the fixing unit 60, leading to discoloration and deformation of the long sheet.

One of the methods to address this problem is to keep on conveying the long sheet to prevent the heat transfer to the long sheet. This method, however, causes the long sheet to have an area with no image formed thereon, leading to waste of sheet and causing cost problems.

In view of such problems, in embodiments of the present invention, the front edge of a long sheet is prohibited from being conveyed into the fixing unit 60 if the fixing unit temperature is higher than a threshold temperature. This can prevent discoloration and deformation of the long sheet at the time of the printing preparation or when the apparatus is in a standby state.

In the embodiments described below, the printing preparation is performed by the control unit 80 executing a predetermined program stored in the storage unit in response to the start of the printing preparation. When the printing preparation is completed, the apparatus is ready for image formation on the long sheet that has been fed.

In the embodiments described below, the fixing roller 611 and the pressure roller 621 are separated from each other at the time of the printing preparation. The threshold temperature is predetermined and stored in the storage unit. Further, the threshold temperature is set to such a temperature that does not damage a long sheet of film conveyed into the fixing unit 60.

First Embodiment

Figure 5:
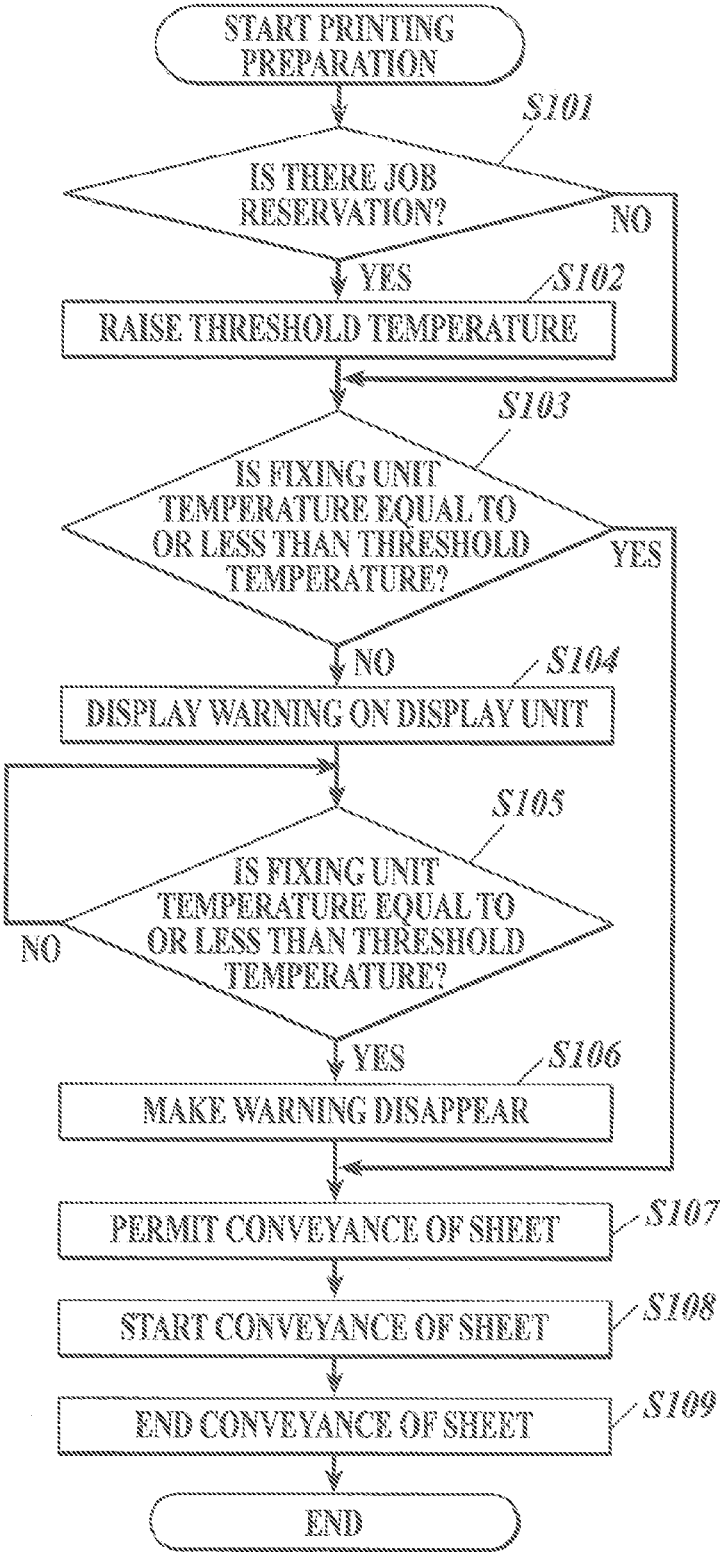
FIG. 5 is a flowchart showing a printing preparation process according to a first embodiment of the present invention.

FIG. 5 is a flowchart describing a first embodiment of the present invention. The first embodiment will now be described with reference to FIG. 5.

In Step S101, the control unit 80 checks for job reservation information stored in the storage unit and determines whether there is a job reservation(s). The job reservation information refers to information on job reservations.

If there is a job reservation ("YES" in Step S101), the control unit 80 raises a threshold temperature related to the determination of whether to permit a conveyance of a long sheet (Step S102). If a job is reserved, the long sheet is to be in a standby state in the fixing unit 60 for only a short period of time, and the long sheet will be less affected by the heat from the fixing unit 60.

In Step S103, the control unit 80 compares the fixing unit temperature with the threshold temperature and determines whether the fixing unit temperature is equal to or less than the threshold temperature.

If the fixing unit temperature is higher than the threshold temperature, ("NO" in Step S103), the control unit 80 displays a warning on the display unit 21 (Step S104). FIG. 6 shows an example warning message.

After the warning has been displayed, the control unit 80 determines again whether the fixing unit temperature is equal to or less than the threshold temperature (Step S105).

If the fixing unit temperature is equal to or less than the threshold temperature ("YES" in Step S105), the control unit 80 makes the warning disappear from the display unit 21 (Step S106), permits the sheet conveyance unit 50 to convey the long sheet, and allows the sheet conveyance unit 50 to be ready to start conveying the long sheet (Step S107).

In Step S108, the control unit 80 allows the sheet conveyance unit 50 to start conveying the long sheet.

The conveyance of the long sheet through the sheet conveyance unit 50 may be performed automatically with conveyance rollers or may be performed manually by a user.

In Step S109, the control unit 80 allows the sheet conveyance unit 50 to end the conveyance of the long sheet.

In Step S101, if there is not a job reservation ("NO" in Step S101), the process goes on to Step S103. In this case, the control unit 80 compares the fixing unit temperature with the threshold temperature and determines whether the fixing unit temperature is equal to or less than the threshold temperature without changing the threshold temperature.

In the first embodiment of the present invention, if the fixing unit temperature is higher than the threshold temperature at the time of the printing preparation, the front edge of the long sheet is prohibited from being conveyed. This can prevent discoloration and deformation of the long sheet that would be caused by a heat transfer to the long sheet, achieving good printing preparation.

Further, the threshold temperature is set to a higher temperature when a job is reserved. This can reduce the time required for a warm-up, without causing deformation and discoloration of the long sheet. Further, the power consumption for the warm-up can be reduced in comparison with the case in which the fixing unit temperature is lowered. The "warm-up" refers to an operation to raise the fixing unit temperature to a temperature necessary for fixation.

In the first embodiment, the job reservation information is information on existence or non-existence of a job reservation. Alternatively, the job reservation information may be information on a period of time before the start of a next job, may be information on the type of a job, or may be a combination of two or more of these information items (including the information on existence or non-existence of a job reservation). In such cases, the threshold temperature may be set to or changed to a more appropriate temperature than in a case in which only existence or non-existence of a job reservation is checked.

Further, a warning is displayed on the display unit 21 if the fixing unit temperature is higher than the threshold temperature. Such a warning display allows a user to easily know that the conveyance of the long sheet is currently prohibited.

Second Embodiment

Figure 7:
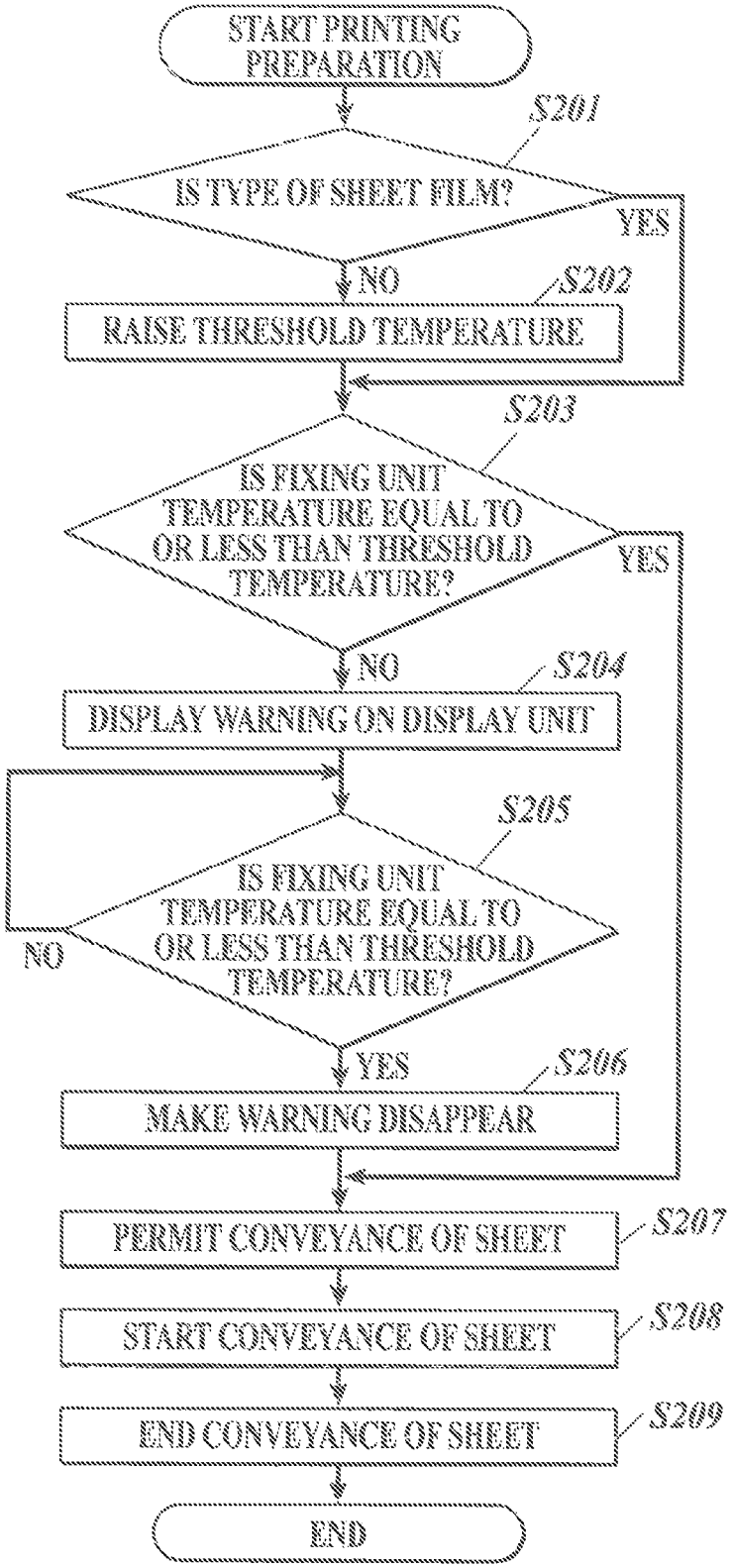
FIG. 7 is a flowchart showing a printing preparation process according to a second embodiment of the present invention.

FIG. 7 is a flowchart describing a second embodiment of the present invention. The second embodiment will now be described with reference to FIG. 7.

In Step S201, the control unit 80 determines whether the type of a sheet to be fed is film.

The "film" refers to a sheet made of resin, such as polypropylene (PP) or polyethylene terephthalate (PET).

A film is apt to be wound around the fixing roller while being conveyed and the film that has been conveyed to the fixing unit 60 is apt to melt or deform while staying in the fixing unit 60. Such problems arise at a lower temperature than when plain paper is used as a sheet.

If the type of sheet is film ("YES" in Step S201), the process goes on to Step S203.

If the type of sheet is not film ("NO" in Step S201), the control unit 80 raises a threshold temperature related to the determination of whether to permit a conveyance of a long sheet (Step S202).

If the type of sheet is not film, the sheet has higher heat durability than a film sheet and thus problems of deformation and discoloration of the sheet are less likely to arise than in the case of the film sheet. Hence, the threshold temperature can be raised to some extent without causing a bad effect, such as deformation and discoloration of the sheet of plain paper, due to the heat to be transferred from the fixing unit 60 to the sheet.

The processes in Steps S203 to S209 performed by the control unit 80 are the same as the Steps S103 to S109 of the first embodiment, and redundant explanations are omitted.

In the second embodiment of the present invention, the threshold temperature is set to a higher temperature if the type of sheet is not film. This can reduce the time required for a warm-up, i.e., the time required to raise the fixing unit temperature to a temperature necessary for fixation. This can also reduce the power consumption for the warm-up in comparison with a case in which the fixing unit temperature is lowered.

In other words, since the threshold temperature is set to a lower temperature if the type of sheet is film, the film is prevented from being wound around the fixing roller and from melting or deforming when the film sheet has reached and stays in the fixing unit 60.

In the second embodiment, the threshold temperature is changed depending on whether the type of sheet is film or not. The threshold temperature may be set or changed depending on whether the sheet is made of material other than film and/or depending on the thickness and/or width of the long sheet as well as the type of the sheet. The threshold temperature can thus be set to or changed to an optimum temperature in accordance with heat durability of the sheet.

Further, since a warning is displayed on the display unit 21 if the temperature of the fixing unit 60 is higher than the threshold temperature, a user can easily know from the warning that the conveyance of the long sheet is currently prohibited.

Third Embodiment

Figure 8:
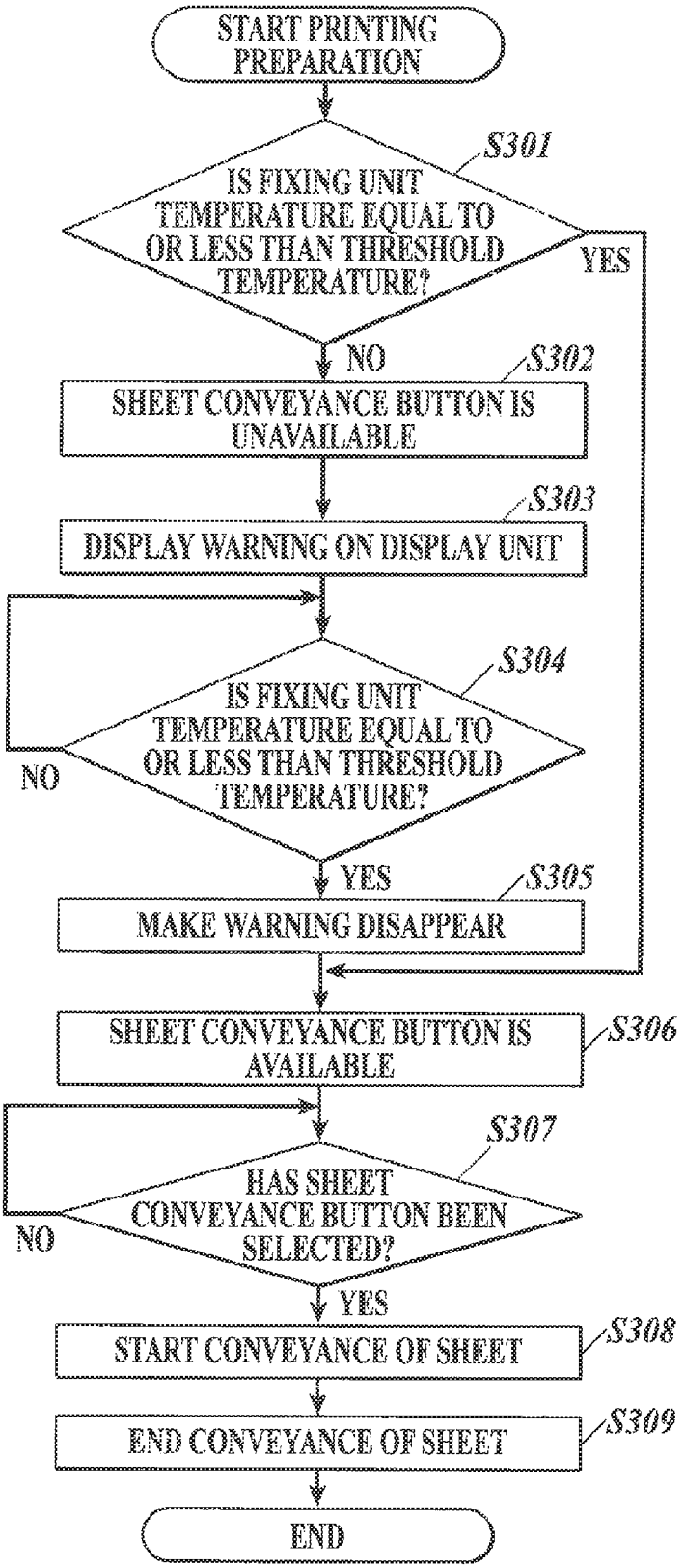
FIG. 8 is a flowchart showing a printing preparation process according to a third embodiment of the present invention.

FIG. 8 is a flowchart describing a third embodiment of the present invention. The third embodiment will now be described with reference to FIG. 8.

An image forming apparatus according to the third embodiment includes a sheet conveyance unit 50 capable of automatically conveying the front edge of a long sheet. A display unit 21 of the third embodiment has a sheet conveyance button to receive an instruction to automatically convey the front edge of the long sheet.

Figure 9:
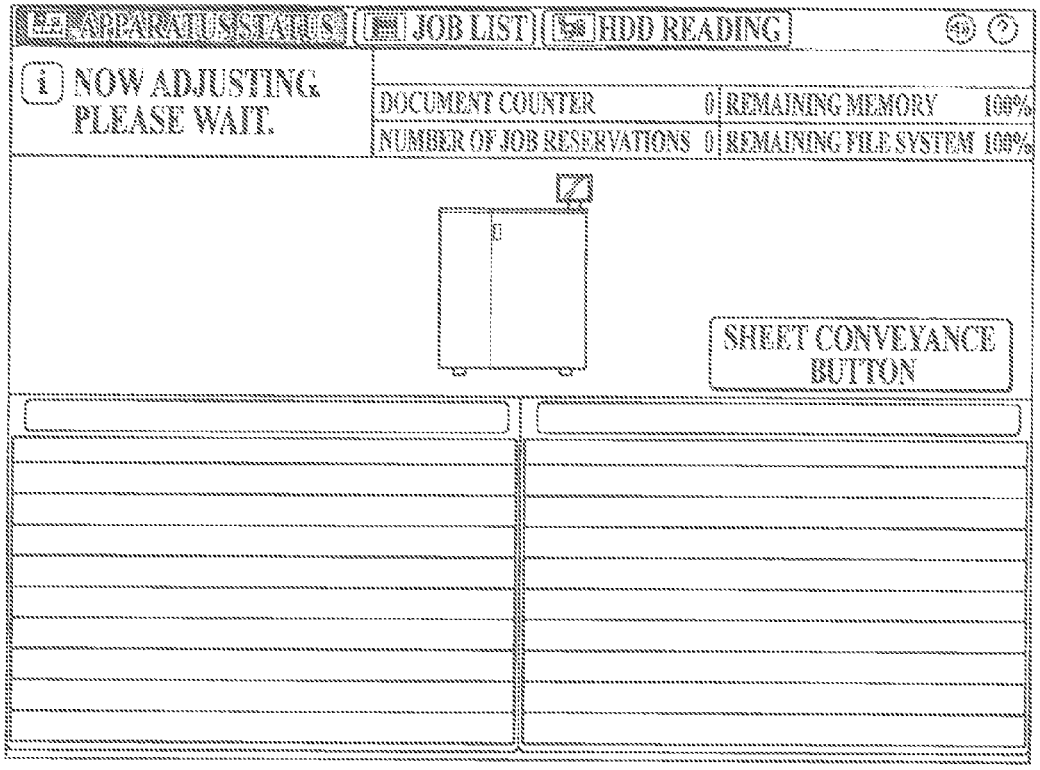
FIG. 9 shows a display unit according to the third embodiment of the present invention.

As shown in FIG. 9, the sheet conveyance button is displayed on the display unit 21 to receive a conveyance instruction from a user. In response to receipt of the conveyance instruction, the control unit 80 allows the sheet conveyance unit 50 to perform the automatic conveyance of a sheet. The automatic conveyance may be performed in such a way that the long sheet is automatically conveyed from the sheet feeder 1A to the winder 1C.

In Step S301, the control unit 80 compares the fixing unit temperature with the threshold temperature and determines whether the fixing unit temperature is equal to or less than the threshold temperature.

If the fixing unit temperature is equal to or less than the threshold temperature ("YES" in Step S301), the process goes on to Step S306.

If the fixing unit temperature is higher than the threshold temperature ("NO" in Step S301), the control unit 80 makes the sheet conveyance button unavailable (i.e., a state in which the sheet conveyance button cannot be selected) (Step S302). Examples of methods for making the sheet conveyance button unavailable include changing the color of the sheet conveyance button into gray so as not to accept a user's input or making the sheet conveyance button disappear from the display unit 21.

In Step S303, the control unit 80 displays a warning on the display unit 21.

After the warning has been displayed, the control unit 80 determines again whether the fixing unit temperature is equal to or less than the threshold temperature (Step S304).

If the fixing unit temperature is equal to or less than the threshold temperature ("YES" in Step S304), the control unit 80 makes the warning disappear from the display unit 21 (Step S305) and makes the sheet conveyance button available (i.e., a state in which the sheet conveyance button can be selected) (Step S306). The sheet conveyance unit 50 becomes ready to start conveying the sheet in response to a user's selection of the sheet conveyance button.

In Step S307, the control unit 80 determines whether the sheet conveyance button has been selected.

If the sheet conveyance button has been selected ("YES" in Step S307), the control unit 80 allows the sheet conveyance unit 50 to start conveying the long sheet (Step S308).

In Step S309, the control unit 80 allows the sheet conveyance unit 50 to end the conveyance of the long sheet.

In the third embodiment of the present invention, if the fixing unit temperature is higher than the threshold temperature, the sheet conveyance button is unavailable so that a user cannot select the sheet conveyance button and so that a conveyance of a sheet is not automatically started.

In the third embodiment, the sheet conveyance button is available at the start of the printing preparation. Alternatively, the sheet conveyance button may be unavailable at the start of the printing preparation. In this case, the sheet conveyance button may become available when the fixing unit temperature becomes equal to or less than the threshold temperature. In this way, if the fixing unit temperature is higher than the threshold temperature, the conveyance instruction to start the automatic conveyance is not accepted and the automatic conveyance of the front edge of the long sheet is prohibited.

Instead of making the sheet conveyance button unavailable, the control unit 80 may ignore the selection of the sheet conveyance button. In this case, the same advantageous effects can be obtained as in the case of the third embodiment.

Further, a warning is displayed on the display unit 21 if the fixing unit temperature is higher than the threshold temperature. Such a warning display allows a user to easily know that the conveyance of the long sheet is currently prohibited.

Fourth Embodiment

Figure 10:
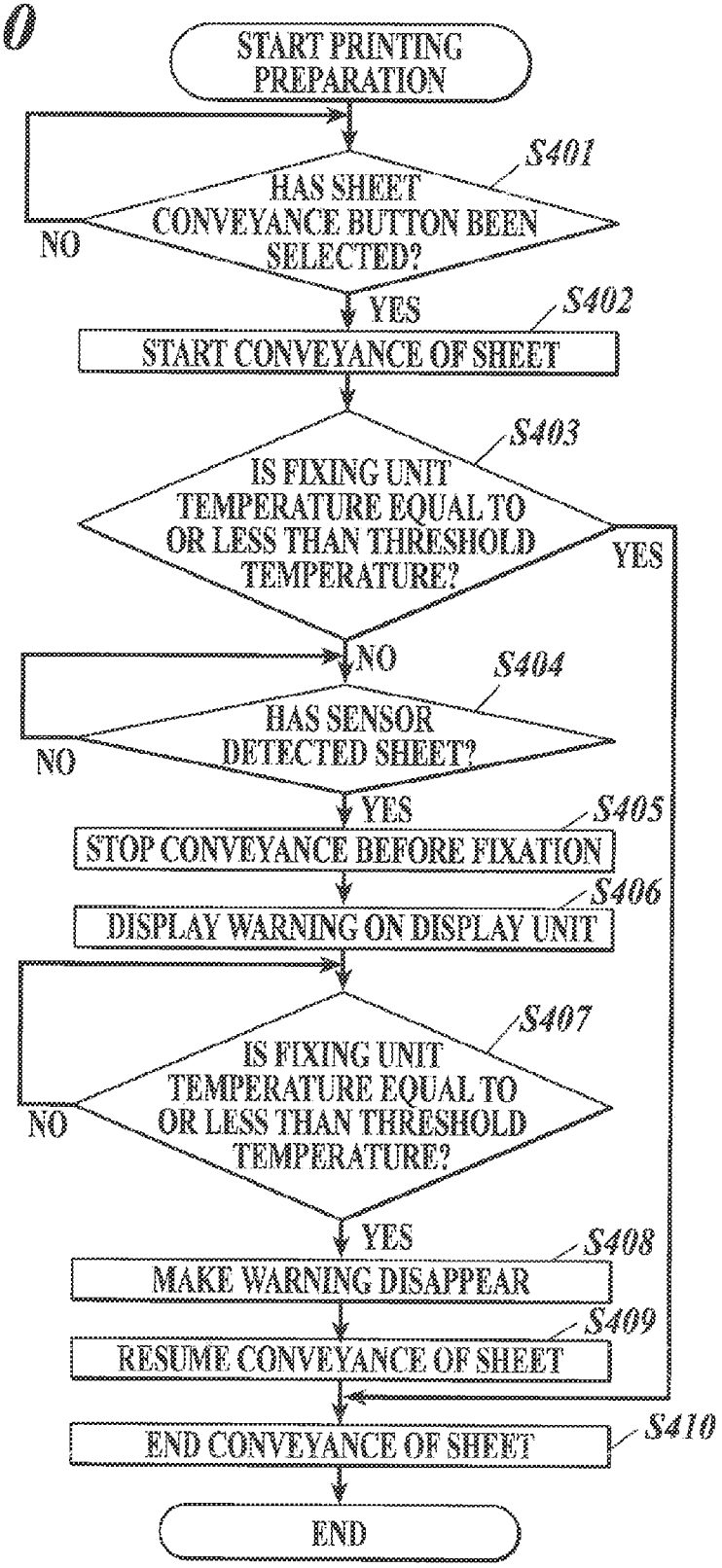
FIG. 10 is a flowchart showing a printing preparation process according to a fourth embodiment of the present invention.

FIG. 10 is a flowchart describing a fourth embodiment of the present invention. The fourth embodiment will now be described with reference to FIG. 10.

An image forming apparatus according to the fourth embodiment includes a sheet sensor 54*a* to detect existence of a sheet disposed upstream of the fixing unit 60 on the sheet conveyance pathway. The term "upstream of the fixing unit 60" refers to a position closer to the sheet feed opening than the fixing unit 60 to the sheet feed opening in the image forming apparatus body 1B.

Figure 11:
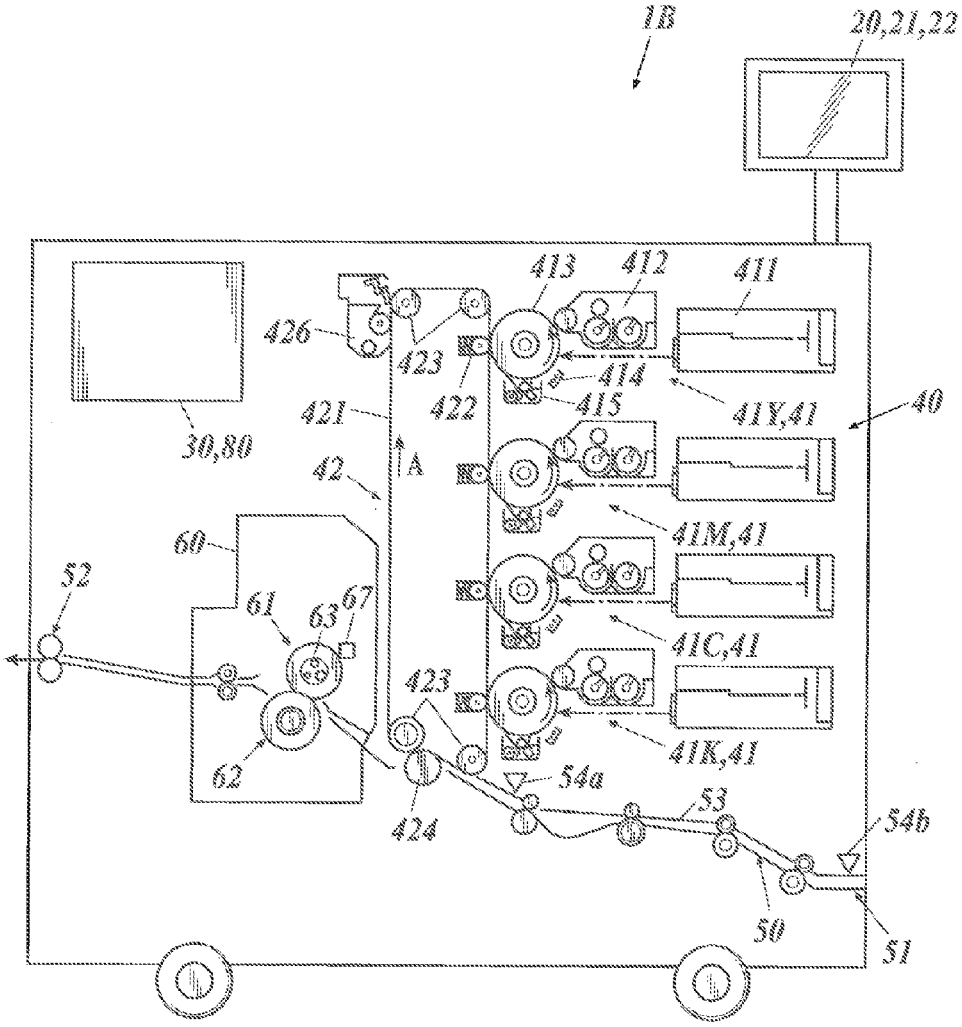
FIG. 11 shows the position of a sheet sensor according to the fourth embodiment of the present invention.

As shown in FIG. 11, the sheet sensor 54*a* is disposed upstream of the fixing unit 60 on the sheet conveyance pathway to detect the existence of a sheet and sends the information to the control unit 80.

In Step S401, the control unit 80 determines whether the sheet conveyance button has been selected.

If the sheet conveyance button has been selected ("YES" in Step S401), the control unit 80 allows the sheet conveyance unit 50 to start conveying the long sheet (Step S402).

In Step S403, the control unit 80 compares the fixing unit temperature with the threshold temperature, and determines whether the fixing unit temperature is equal to or less than the threshold temperature.

If the fixing unit temperature is equal to or less than the threshold temperature ("YES" in Step S403), the process goes on to Step S410.

If the fixing unit temperature is higher than the threshold temperature ("NO" in Step S403), the control unit 80 determines whether the sheet sensor 54*a* has detected a long sheet (Step S404).

If the sheet sensor 54*a* has detected a long sheet ("YES" in Step S404), the control unit 80 allows the sheet conveyance unit 50 to stop conveying the long sheet (Step S405). The long sheet stops near the sheet sensor 54*a*. Since the sheet sensor 54*a* is upstream of the fixing unit 60, the conveyance stops when the long sheet is disposed upstream of the fixing unit 60. The control unit 80 then displays a warning on the display unit 21 (Step S406).

In Step S407, the control unit 80 again compares the fixing unit temperature with the threshold temperature and determines whether the fixing unit temperature is equal to or less than the threshold temperature.

If the fixing unit temperature is higher than the threshold temperature ("NO" in Step S407), the control unit 80 keeps the long sheet stopped until the fixing unit temperature becomes equal to or less than the threshold temperature.

If the fixing unit temperature is equal to or less than the threshold temperature ("YES" in Step S407), the control unit 80 makes the warning disappear from the display unit 21

(Step S408) and allows the sheet conveyance unit 50 to resume the conveyance of the long sheet (Step S409).

In Step S410, the control unit 80 allows the sheet conveyance unit 50 to end the conveyance of the long sheet.

In the fourth embodiment, when the automatic conveyance of a long sheet is performed, the conveyance is stopped before the long sheet reaches the fixing unit 60 if the fixing unit temperature is higher than the threshold temperature and if the sheet sensor 54*a* detects the long sheet. Accordingly, deformation and discoloration of the long sheet can be prevented. Further, since the conveyance is automatically stopped, the conveyance of the sheet is stopped before the sheet reaches the fixing unit 60 even when a user does not know that the fixing unit temperature is high.

In the fourth embodiment, the control unit 80 makes the determination in Step S403. Alternatively, the determination may be made prior to the start of the conveyance of the sheet in Step S402 or prior to the selection of the sheet conveyance button in Step S401. In such cases, if the fixing unit temperature is equal to or less than the threshold temperature as the result of the determination, the sheet is conveyed without stopping from the start to the end of the conveyance. If, on the other hand, the fixing unit temperature is higher than the threshold temperature, the conveyance is stopped before fixation in response to the detection of the sheet by the sheet sensor 54*a*, and the sheet remains stopped until the fixing unit temperature becomes equal to or less than the threshold temperature.

The sheet sensor 54*a* is disposed preferably immediately anterior to the fixing unit 60 (e.g., downstream of the image forming unit 40). Stopping the conveyance of the sheet immediately anterior to the fixing unit 60 advantageously reduces the time required for the sheet to reach the fixing unit 60 and the sheet output opening of the image forming apparatus body 1B when the conveyance is resumed, leading to reduction in time required for the printing preparation.

Further, a warning is displayed on the display unit 21 if the fixing unit temperature is higher than the threshold temperature. Such a warning display allows a user to easily know that the conveyance of the long sheet is currently prohibited.

Fifth Embodiment

Figure 12:
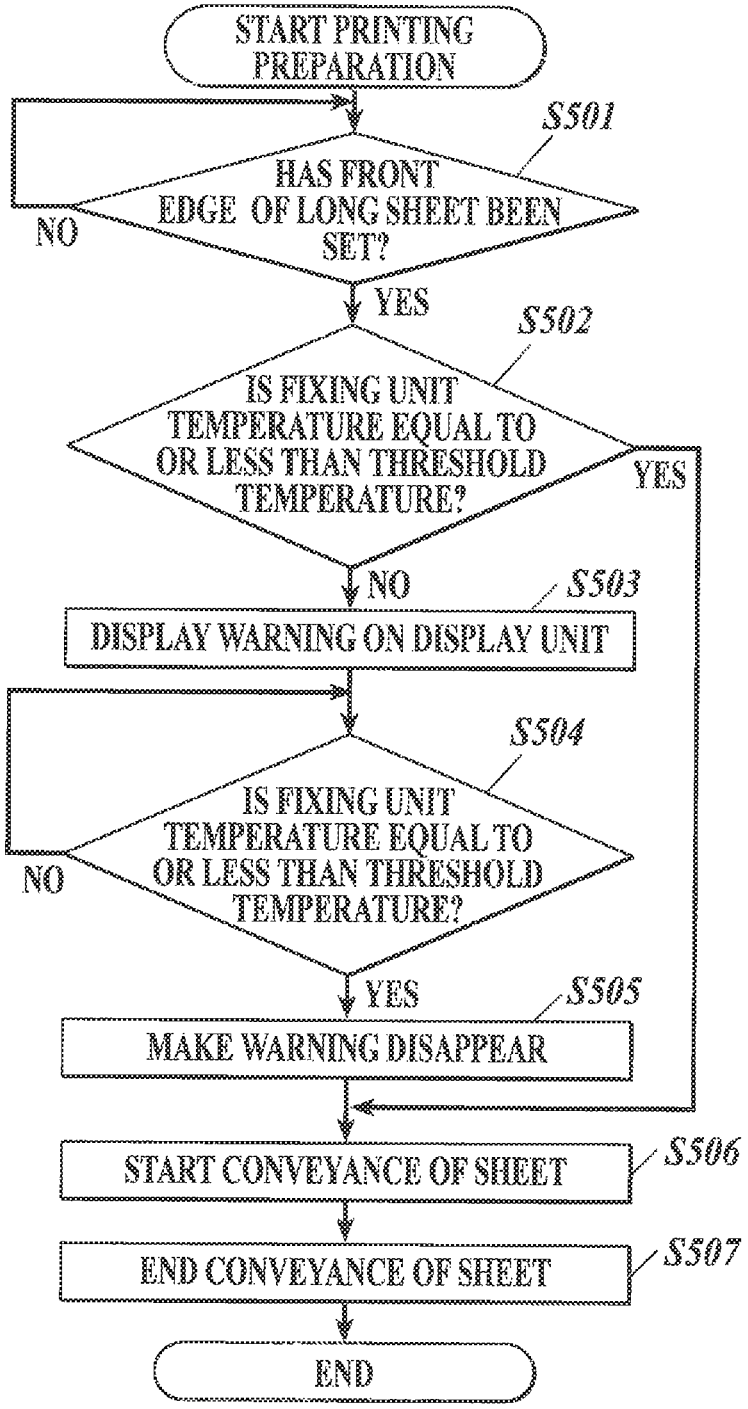
FIG. 12 is a flowchart showing a printing preparation process according to a fifth embodiment of the present invention.

FIG. 12 is a flowchart describing a fifth embodiment of the present invention. The fifth embodiment will now be described with reference to FIG. 12.

An image forming apparatus according to the fifth embodiment includes a sheet sensor 54*b* to detect existence of a sheet disposed upstream of the fixing unit 60 on the sheet conveyance pathway.

As shown in FIG. 11, the sheet sensor 54*b* detects the front edge of a long sheet set at the sheet feeding section 51 and sends the information to the control unit 80.

In Step S501, the control unit 80 determines whether the front edge of a long sheet has been set at the sheet feed opening of the image forming apparatus body 1B.

If the front edge of a long sheet has been set ("YES" in Step S501), the control unit 80 determines whether the fixing unit temperature is equal to or less than the threshold temperature (Step S502).

If the fixing unit temperature is equal to or less than the threshold temperature ("YES" in Step S502), the process goes on to Step S506.

If the fixing unit temperature is higher than the threshold temperature ("NO" in Step S502), the control unit 80 displays a warning on the display unit 21 (Step S503). After the warning has been displayed, the control unit 80 determines again whether the fixing unit temperature is equal to or less than the threshold temperature (Step S504).

If the fixing unit temperature is equal to or less than the threshold temperature ("YES" in Step S504), the control unit 80 makes the warning disappear from the display unit 21 (Step S505).

In Step S506, the control unit 80 allows the sheet conveyance unit 50 to start conveying the long sheet.

In Step S507, the control unit 80 allows the sheet conveyance unit 50 to end the conveyance of the sheet.

In the fifth embodiment, when an automatic conveyance of a long sheet is to be performed, the conveyance of the long sheet is not permitted to start if the fixing unit temperature is higher than the threshold temperature and if the sheet sensor 54*b* has detected the front edge of the long sheet that has been set. Accordingly, deformation and discoloration of the long sheet can be prevented.

Further, a warning is displayed on the display unit 21 if the fixing unit temperature is higher than the threshold temperature. A user thus can easily know, from the warning display, that the conveyance of the long sheet is currently prohibited when the user sets the front edge of the long sheet.

Sixth Embodiment

Figure 13:
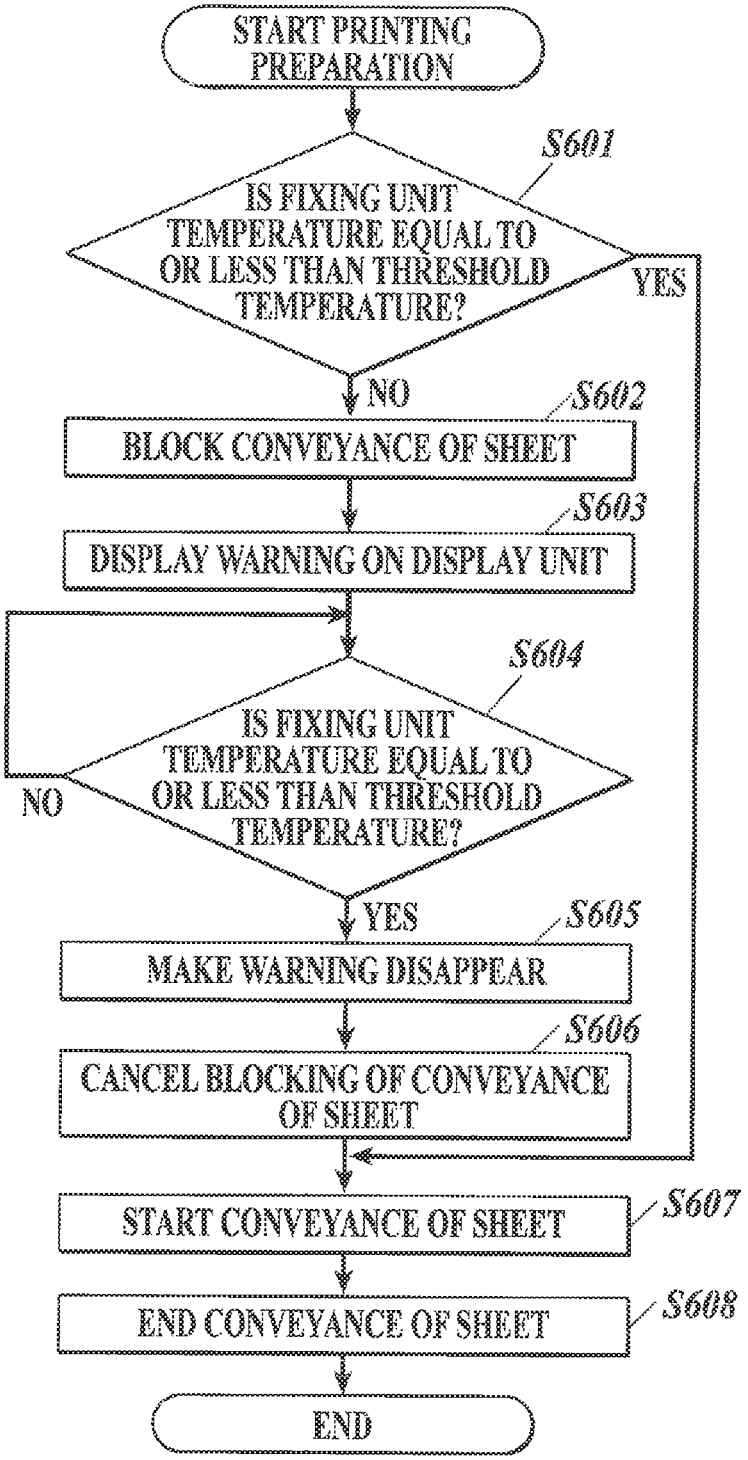
FIG. 13 is a flowchart showing a printing preparation process according to a sixth embodiment of the present invention.

FIG. 13 is a flowchart describing a sixth embodiment of the present invention. The sixth embodiment will now be described with reference to FIG. 13.

An image forming apparatus according to the sixth embodiment includes a sheet conveyance blocking member disposed upstream of the fixing unit 60 in the sheet conveyance unit 50.

Figure 14:
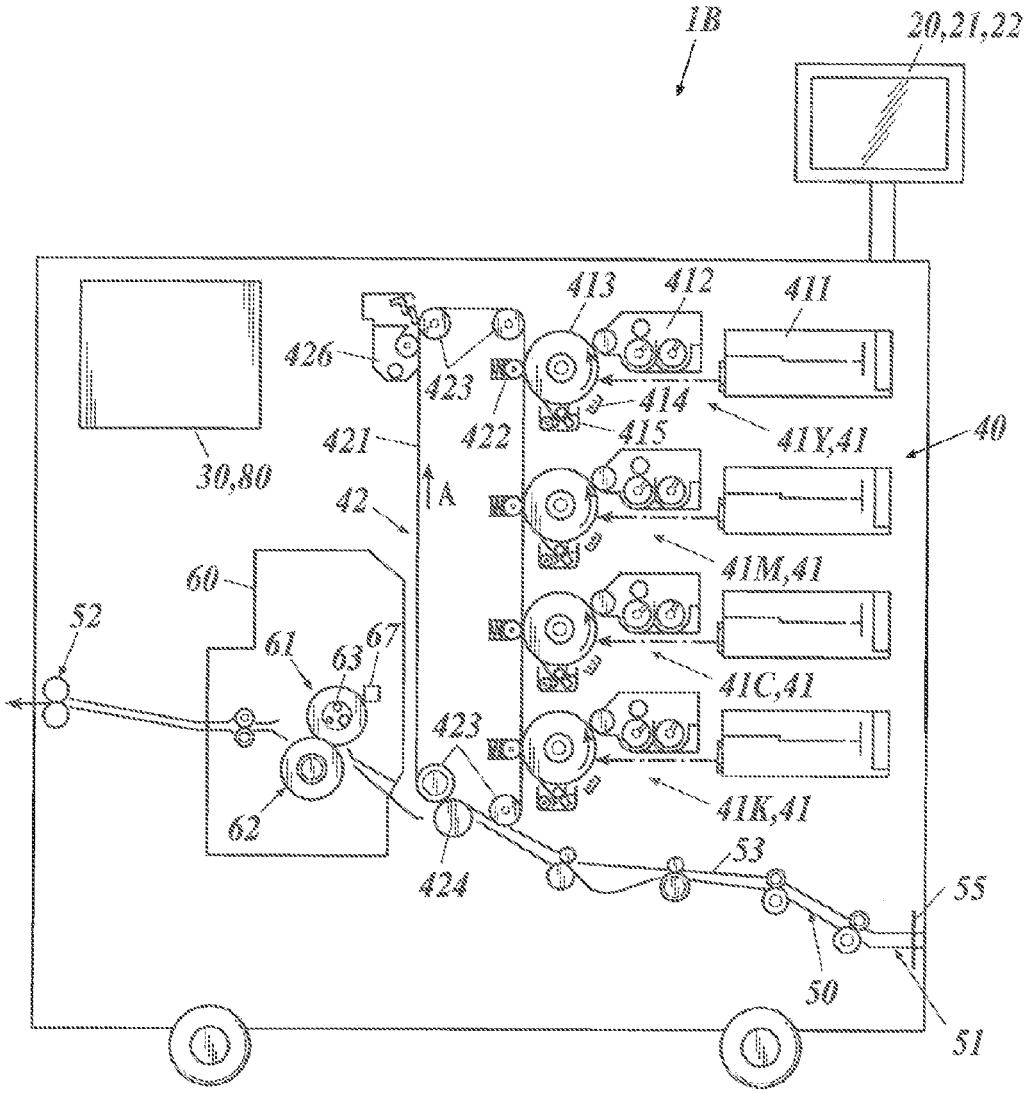
FIG. 14 shows a shutter according to the sixth embodiment of the present invention.
Figure 15:
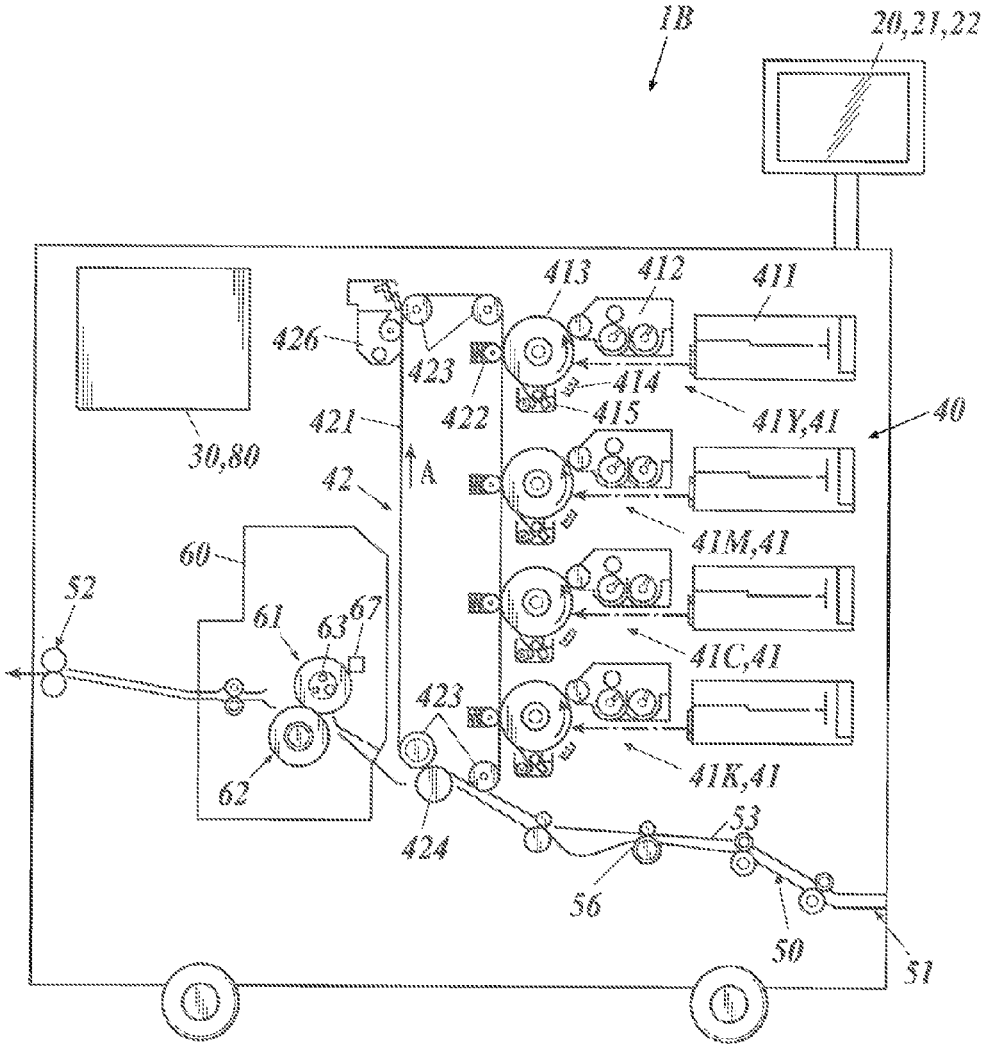
FIG. 15 shows a nipping part according to the sixth embodiment of the present invention.

A shutter 55 and a nip part 56 are shown in FIG. 14 and FIG. 15, respectively, as examples of the sheet conveyance blocking member.

In the sixth embodiment, a conveyance of a long sheet is manually performed.

In Step S601, the control unit 80 determines whether the fixing unit temperature is equal to or less than the threshold temperature.

If the fixing unit temperature is higher than the threshold temperature ("NO" in Step S601), the control unit 80 allows the sheet conveyance blocking member to block the conveyance of the front edge of a long sheet (Step S602), and displays a warning on the display unit 21 (Step S603).

After blocking the conveyance of the sheet, the control unit 80 determines again whether the fixing unit temperature is equal to or less than the threshold temperature (Step S604).

If the fixing unit temperature is equal to or less than the threshold temperature ("YES" in Step S604), the control unit 80 makes the warning disappear from the display unit 21 (Step S605), and cancels the blocking of the conveyance of the sheet (Step S606). The conveyance of the long sheet is then permitted in response to the cancellation of the blocking.

In Step S607, the control unit 80 allows the sheet conveyance unit 50 to start conveying the long sheet.

In Step S608, the control unit 80 allows the sheet conveyance unit 50 to end the conveyance of the long sheet.

In the sixth embodiment, if the fixing unit temperature is higher than the threshold temperature, the sheet conveyance blocking member blocks conveyance of the long sheet when a user tries to convey the long sheet. Thus the long sheet cannot be conveyed and the front edge of the long sheet is prevented from being conveyed into the fixing unit 60.

A sheet conveyance unit 50 with an automatic conveyance unit could allow manual insertion of a long sheet when the sheet conveyance is prohibited, as in the fifth embodiment.

The sixth embodiment, on the other hand, can prohibit a long sheet from being conveyed into the fixing unit 60 because the conveyance of the sheet is blocked in the sixth embodiment.

In the sixth embodiment, Steps S601 to S606 are performed before the start of the conveyance of the sheet. Alternatively, the conveyance of the sheet may be started before Steps S601 to S606.

In the first to sixth embodiments, the first and second predetermined temperatures are set, as the threshold temperature, based on a case in which a long sheet of film is fed. Alternatively, the first and second predetermined temperatures may be set based on a case in which a long sheet of plain paper is fed.

In the embodiments, the first and second predetermined temperatures are the same temperature (threshold temperature). Alternatively, the first and second predetermined temperatures may be different from each other.

In the embodiments, the apparatus waits until the fixing unit temperature drops due to spontaneous heat release. Alternatively, the apparatus may be provided with a fan to send air to the fixing roller or the pressure roller to forcibly lower the fixing unit temperature.

The present invention is not limited to the embodiments described above but may be modified as appropriate without departing from the spirit of the present invention.

The entire disclosure of Japanese Patent Application No. 2014-197729 filed on Sep. 29, 2014 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An image forming apparatus comprising:

a sheet conveyance unit which conveys a long sheet having such a length that the long sheet is to extend at least from a sheet feed opening to a sheet output opening of an image forming apparatus body;

an image forming unit which transfers a toner image onto the long sheet;

a fixing unit comprising a heater to fix the transferred toner image;

a temperature detector which detects a temperature of the fixing unit; and a control unit which controls the sheet conveyance unit to convey the long sheet through the sheet feed opening of the image forming apparatus body, the image forming unit, the fixing unit, and the sheet output opening of the image forming apparatus body in this order, wherein the control unit controls the sheet conveyance unit in such a way that, when the sheet conveyance unit is to convey a front edge of the long sheet from the sheet feed opening to the sheet output opening of the image forming apparatus body with no toner image transferred onto the long sheet by the image forming unit, the front edge of the long sheet is prohibited from being conveyed into the fixing unit if the temperature of the fixing unit detected by the temperature detector is higher than a first predetermined temperature.

2. The image forming apparatus according to claim 1, wherein the control unit checks for job reservation information on a job reservation, and sets or changes the first predetermined temperature on the basis of the job reservation information.

3. The image forming apparatus according to claim 2, wherein the job reservation information comprises information on existence or non-existence of the job reservation.

4. The image forming apparatus according to claim 1, wherein the control unit sets or changes the first predetermined temperature on the basis of at least one of a type, a thickness, and a width of the long sheet.

5. The image forming apparatus according to claim 1, wherein the sheet conveyance unit comprises an automatic conveyance unit which performs an automatic conveyance to automatically convey the front edge of the long sheet at least from the sheet feed opening to the sheet output opening of the image forming apparatus body; and the control unit stops receiving a conveyance instruction if the temperature of the fixing unit is higher than the first predetermined temperature, the conveyance instruction being an instruction to allow the automatic conveyance unit to start the automatic conveyance.

6. The image forming apparatus according to claim 1, wherein the sheet conveyance unit comprises a sheet detector which detects existence of the long sheet upstream of the fixing unit on a sheet conveyance pathway; and if the temperature of the fixing unit is higher than the first predetermined temperature and the sheet detector detects the long sheet, the control unit prohibits the front edge of the long sheet from being conveyed.

7. The image forming apparatus according to claim 1, wherein the sheet conveyance unit comprises a sheet conveyance blocking member which blocks conveyance of the long sheet, the sheet conveyance blocking member being disposed upstream of the fixing unit on a sheet conveyance pathway; and the control unit allows the sheet conveyance blocking member to block the conveyance of the long sheet if the temperature of the fixing unit is higher than the first predetermined temperature.

8. The image forming apparatus according to claim 1, further comprising a display unit on which the control unit displays information based on a signal input from the control unit, wherein the control unit displays, on the display unit, a warning which tells a user not to convey the front edge of the long sheet to prohibit the front edge of the long sheet from being conveyed if the temperature of the fixing unit is higher than the first predetermined temperature.

9. The image forming apparatus according to claim 1, wherein the control unit resumes or starts conveying the front edge of the long sheet if the temperature of the fixing unit becomes equal to or less than a second predetermined temperature after the control unit prohibits the front edge of the long sheet from being conveyed into the fixing unit.

* * * * *